US009387966B2

(12) United States Patent
Chiang et al.

(10) Patent No.: US 9,387,966 B2
(45) Date of Patent: Jul. 12, 2016

(54) LID OF DISPOSABLE BEVERAGE CUP

(71) Applicants: Charles N. Chiang, Monterey Park, CA (US); Benjamin H. Chiang, Monterey Park, CA (US)

(72) Inventors: Charles N. Chiang, Monterey Park, CA (US); Benjamin H. Chiang, Monterey Park, CA (US)

( * ) Notice: Subject to any disclaimer, the term of this patent is extended or adjusted under 35 U.S.C. 154(b) by 0 days.

(21) Appl. No.: 14/289,625

(22) Filed: May 28, 2014

(65) Prior Publication Data

US 2015/0014321 A1 Jan. 15, 2015

Related U.S. Application Data

(62) Division of application No. 13/987,188, filed on Jul. 8, 2013, now Pat. No. 8,851,325.

(51) Int. Cl.

| | |
|---|---|
| ***A47G 19/22*** | (2006.01) |
| ***B65D 51/16*** | (2006.01) |
| ***B65D 43/02*** | (2006.01) |

(52) U.S. Cl.

CPC ..... *B65D 51/16* (2013.01); *A47G 19/2272* (2013.01); *B65D 43/0212* (2013.01); *B65D 2205/025* (2013.01); *B65D 2543/00046* (2013.01)

(58) Field of Classification Search

CPC ... A47G 19/22; A47G 19/2272; B65D 51/16; B65D 41/46

USPC ..... 220/254.3, 254.7, 266, 281, 375, 379, 220/719, 731, 789, 791, 793; 229/404, 229/906.1

See application file for complete search history.

(56) References Cited

U.S. PATENT DOCUMENTS

| | | | | |
|---|---|---|---|---|
| 8,851,325 | B1 * | 10/2014 | Chiang et al. | 220/731 |
| 2005/0045634 | A1 * | 3/2005 | Ward et al. | 220/254.3 |
| 2009/0266828 | A1 * | 10/2009 | Cai | B65D 43/0212 220/712 |

* cited by examiner

*Primary Examiner* — Fenn Mathew
*Assistant Examiner* — Elizabeth Volz
(74) *Attorney, Agent, or Firm* — Raymond Y. Chan; David and Raymond Patent Firm

(57) ABSTRACT

A lid of a disposable beverage cup, which has at least one drinking hole provided for a consumer to drink the beverage stored in the beverage cup, and at least one vent hole provided for maintaining the pressure equivalence between an inner side and an outer side of the beverage cup, includes at least one drinking hole plug arranged for detachably coupling with the drinking hole to seal and close the drinking hole so as to prevent the beverage from leaking out of the beverage cup.

16 Claims, 15 Drawing Sheets

LID OF DISPOSABLE BEVERAGE CUP

CROSS REFERENCE OF RELATED APPLICATION

This is a Divisional application that claims the benefit of priority under 35 U.S.C. §119 to a non-provisional application, application Ser. No. 13/987,188, filed Jul. 8, 2013.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to a disposable beverage cup, and more particularly to a disposable lid for the disposable beverage cup, which provides a spill proof ability to prevent any beverage leak especially when the disposable beverage cup is tipped.

2. Description of Related Arts

A conventional disposable lid of a disposable beverage cup on the current market, which is usually made of plastic, typically has a drinking hole arranged for a user to drink the beverage in the disposable beverage cup, and a vent hole that allows air venting into the disposable beverage cup therethrough for maintaining the balance of the pressure between the inside and outside of the disposable beverage cup. However, the conventional lid has several drawbacks.

A major drawback of the conventional lid is that the conventional lid provides a relatively weak sealing and leak proof ability. In other words, the disposable beverage cup with the conventional lid is inconvenient for carrying. Most of lids in the current market have exposed drinking holes and vent holes. An improved lid may further comprise a valve only provided at the drinking hole. However, the structure of the valve is complicated which will highly increase the manufacturing cost of the lid. In fact, none of the existing lid provides any seal to seal the vent hole of the lid.

Since the size of the drinking hole is larger than the size of vent hole, the beverage in the disposable beverage cup will be spilled out through the drinking hole when the disposable beverage cup is tipped. Accordingly, the beverage in the disposable beverage cup may be spilled onto a table, a floor, clothes, file documents, or inside a car, resulting in unnecessary trouble and loss. Worse yet, if the beverage is hot, consumer may get seriously burnt.

Furthermore, since the consumer must pay more attention on carefully holding the disposable beverage cup, he or she may loss focus on other things, which may cause potential hazard. For example, when the consumer carefully holds the disposable beverage cup during driving, he or she may loss focus on driving which may cause accident. Since the beverage is easy to leak out, some people may even pour out the beverage onto a road, or discard the disposable beverage cup onto a green area aside a road or a lawn of a front yard of a house and polluting our environment.

Another solution found in some fast-food restaurants or beverage shops is to provide a beverage tray which is made of cardboard for retaining the disposable beverage cup at the upright position. A beverage tray can typically hold four to six disposable beverage cups. It will be a waste when the customer only buys one or two disposable beverage cups but the seller still has to supply an oversized tray. It will increase the cost and produce additional trashes and possibly environment pollution.

SUMMARY OF THE PRESENT INVENTION

The main object of the present invention is to provide a lid of a disposable beverage cup, especially a disposable lid, which provides a spill proof ability to prevent any beverage leak especially when the disposable beverage cup is tipped.

Another object of the present invention is to provide a lid of a disposable beverage cup, which comprises a drinking hole plug adapted to be torn off from a lid cover in order to detachably engage with and sealed at the drinking hole for preventing beverage in the container being leaked from the drinking hole.

Another object of the present invention is to provide a lid of a disposable beverage cup, which contains a drinking plug pit to temporally hold the drinking hole plug after the drinking hole plug is detached from the lid cover.

Another object of the present invention is to provide a lid of a disposable beverage cup, which comprises a vent plug adapted to be torn off from a lid cover in order to detachably engage with and sealed at the air vent. Therefore, the drinking hole and the air vent are completely sealed by the drinking hole plug and vent plug respectively to prevent any leaking and external substance, such as dirt, entering into the container. On the other hand, the drinking hole plug and vent plug can be easily removed from the drinking hole and the air vent respectively.

Another object of the present invention is to provide a lid of a disposable beverage cup, wherein at least one expansion membrane is provided at a lateral side and/or a top side of the lid, so that when the disposable beverage cup is reversed, the expansion of the expansion member will produce negative pressure within the disposable beverage cup, so that beverage leakage is prevented.

Another object of the present invention is to provide a lid of a disposable beverage cup, wherein the lid covers can be packed and stacked together to save the packaging space of the present invention.

Another object of the present invention is to provide a lid of a disposable beverage cup, which does not require to alter the original structural design of the disposable beverage cup, so as to minimize the manufacturing cost of the disposable beverage cup incorporating with the lid of the present invention.

Another object of the present invention is to provide a lid of a disposable beverage cup, wherein no expensive or complicated structure is required to employ in the present invention in order to achieve the above mentioned objects. Therefore, the present invention successfully provides an economic and efficient solution for providing a sealing arrangement and configuration for the disposable beverage cup.

Additional advantages and features of the invention will become apparent from the description which follows, and may be realized by means of the instrumentalities and combinations particularly point out in the appended claims.

According to the present invention, the foregoing and other objects and advantages are attained by a lid for container such as a disposable beverage cup, wherein the lid comprises a lid cover and an enclosure arrangement.

The lid cover has a peripheral sealing edge for sealing at an opening edge of the container and a top cover for covering at an opening of the container, wherein the lid cover further has a drinking hole provided on the top cover.

The enclosure arrangement comprises a drinking hole plug integrally and outwardly extended from the sealing edge of the lid cover in a detachably tearable manner, wherein after the drinking hole plug is torn off from the lid cover, the drinking hole plug is detachably engaged with and sealed at the drinking hole for preventing beverage in the container being leaked from the drinking hole.

The present invention further provides a method of manufacturing a lid for a disposable beverage cup, wherein the method comprises the following steps.

(1) Form a lid cover which has a peripheral sealing edge for sealing at an opening edge of the container and a top cover for covering at an opening of the container, wherein the lid cover further has a drinking hole provided on the top cover.

(2) Integrally form a drinking hole plug along the sealing edge of the lid cover in a detachably tearable manner. Accordingly, the drinking hole plug is adapted to be torn off from the lid cover. After the drinking hole plug is torn off from the lid cover, the drinking hole plug is detachably engaged with and sealed at the drinking hole for preventing beverage in the container being leaked from the drinking hole.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
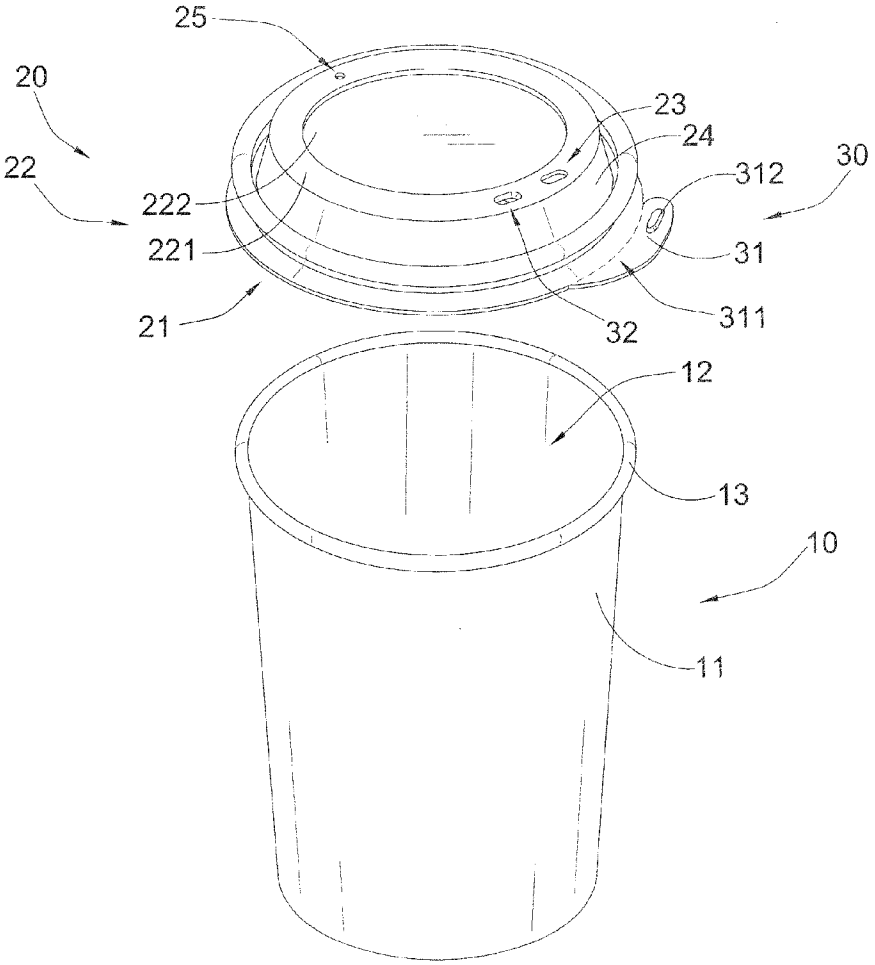
FIG. 1 is a perspective view of a lid of a disposable beverage cup according to a first preferred embodiment of the present invention.

Referring to FIG. 1 of the drawings, a lid for a container according to a first preferred embodiment is illustrated, wherein the container 10 is embodied as a disposable beverage cup for containing beverage, as an example. The container 10 has a container wall 11, a top opening 12, and an opening edge 13. In particular, the opening edge 13 of the container 10 preferably has a thickened configuration to retain the shape of the top opening 12.

According to a first preferred embodiment, the lid, which can be a disposable lid, comprises a lid cover 20 and an enclosure arrangement 30. The lid can be made of disposable material, such as plastic, and can be made by any existing manufacturing process.

Figure 2:
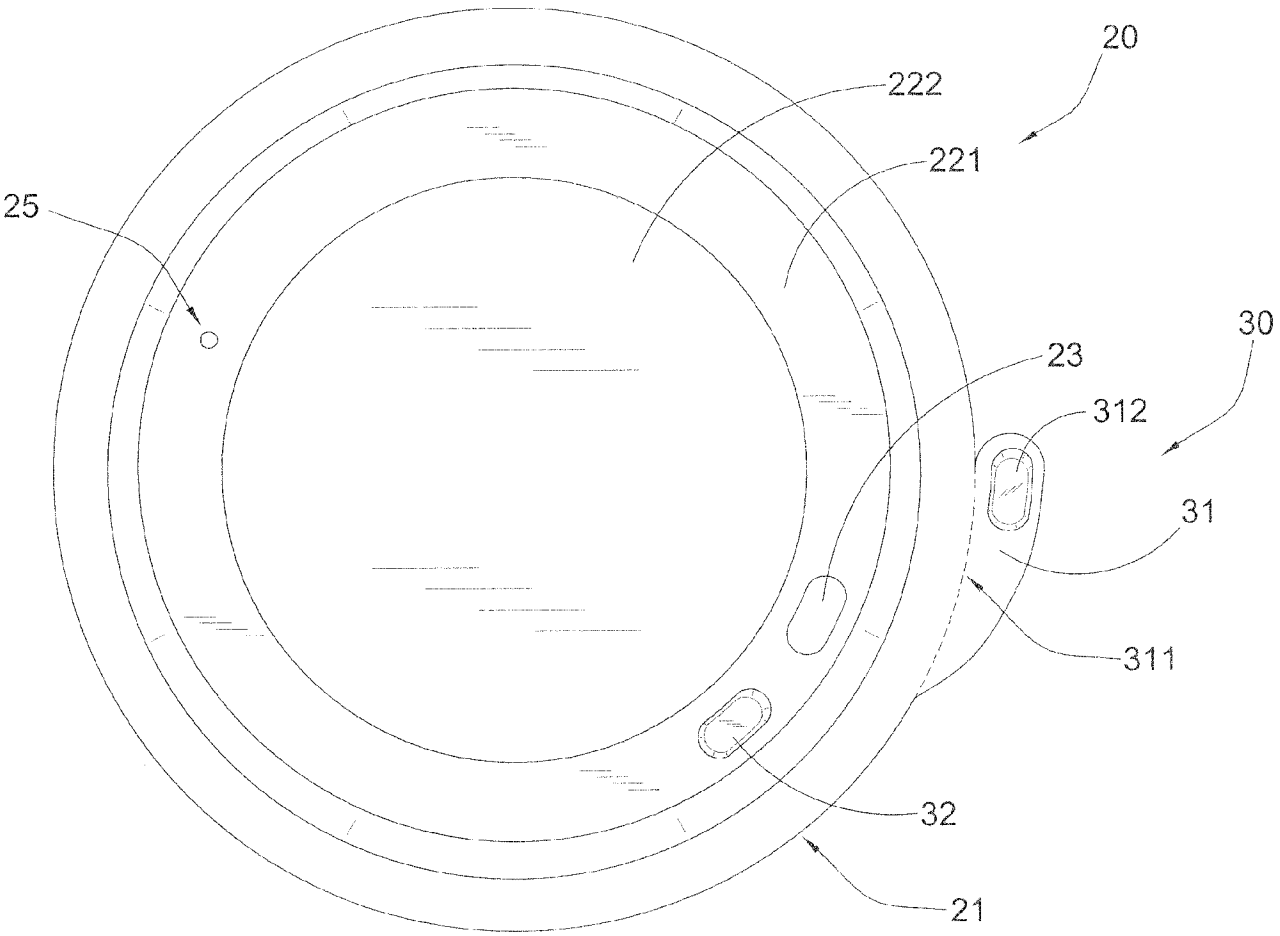
FIG. 2 is a top view of the lid according to the above first preferred embodiment of the present invention.
Figure 3:
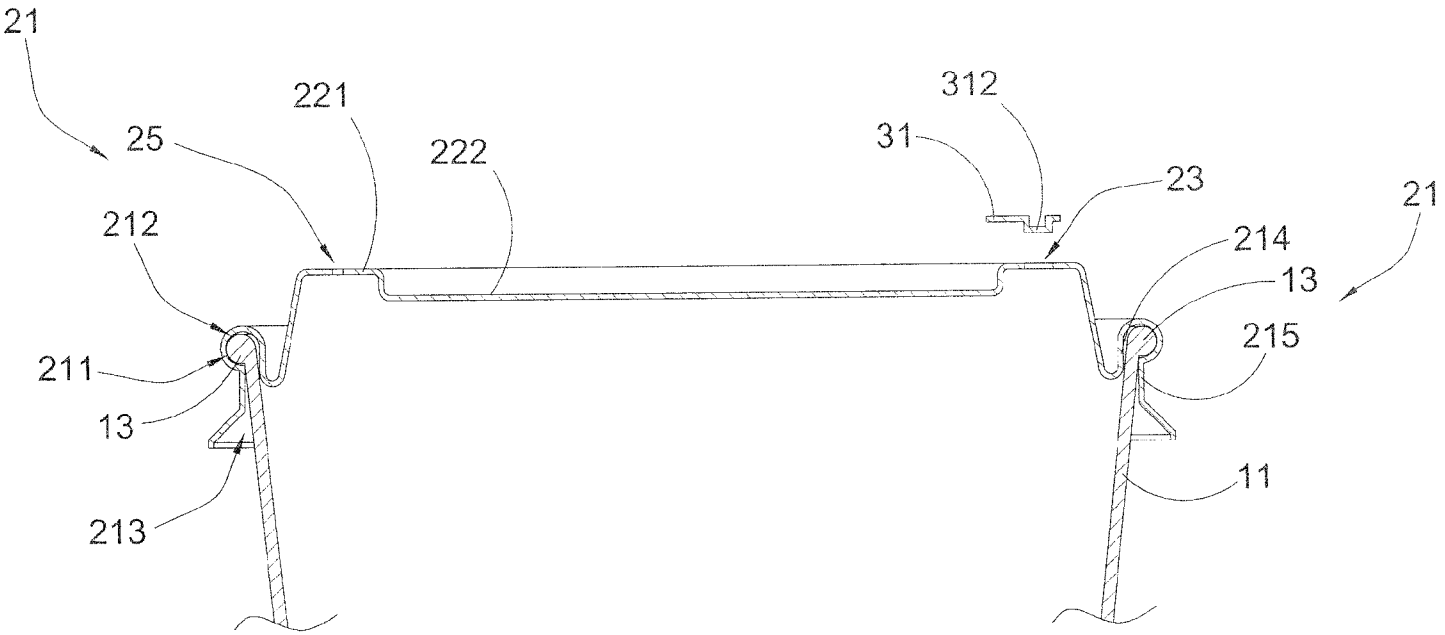
FIG. 3 is a sectional view of the lid according to the above first preferred embodiment of the present invention.

As shown in FIGS. 1 to 3, the lid cover 20, which is preferably form in a circular shape, has a peripheral sealing edge 21 for sealing at the opening edge 13 of the container 10 and a top cover 22 for covering at the top opening 12 of the container 10, wherein when the container 10 is covered by the lid cover 20, a container cavity of the container 10 is concealed. Accordingly, the lid cover 20 further has a drinking hole 23, which is a through hole, provided on the top cover 22 for communicating with the container cavity of the container 10. In other words, the user is able to drink the beverage in the container 10 through the drinking hole 23. It is worth mentioning that the size and shape of the drinking hole 23 can be altered such as circular hole, oval hole, or bean shaped hole.

According to the preferred embodiment, the lid cover 20 comprises a surrounding wall 24 downwardly extended from the top cover 22 to define the sealing edge 21 at a bottom edge of the surrounding wall 24. The top cover 22 further has a peripheral raised deck 221 and a center lowered platform 222, wherein the drinking hole 23 is formed at the peripheral raised deck 221 of the top cover 22.

The lid cover 20 further has an air vent 25 provided on the top cover 22 for enabling air passing therethrough. Preferably, the air vent 25 is provided at the peripheral raised deck 221 of the top cover 22 at a position along the diameter of the top cover 22 to maximize the distance between the drinking hole 23 and the air vent 25. Accordingly, the size of the air vent 25 is smaller than the size of the drinking hole 23, wherein the air vent 25 is used for maintaining and balancing the interior pressure of the container 10 with the exterior thereof during drinking when the lid cover 20 is sealed at the container 10. In other words, when the user drinks the beverage through the drinking hole 23, the ambient air will enter into the cavity of the container 10 through the air vent 25 to ensure the beverage to be smoothly flow out of the container 10 through the drinking hole 23. Preferably, the air vent 25 is small enough for only enabling air passing therethrough.

According to the preferred embodiment, the sealing edge 21 of the lid cover 20, having an invert U-shape, defines sealing cavity 211 having an enlarged top closed end 212 and an elongated bottom open end 213 for sealing with and receiving the opening edge 13 of the container 10 at the sealing cavity 211. In particular, the sealing edge 21 of the lid cover 20 comprises an inner wall 214 and an outer wall 215 to define the sealing cavity 211 therebetween. The inner wall 214 is upwardly and integrally extended from the surrounding wall 24 of the lid cover 20. The inner and outer walls 214, 215 are integrally extended at the top sides thereof to define the enlarged top closed end 212 while the bottom sides of the inner and outer walls 214, 215 form the elongated bottom open end 213. Therefore, when the lid cover 20 covers on the top opening 12 of the container 10, the opening edge 13 of the container 10 is sealed at and received in the enlarged top closed end 212 while an upper portion of the container wall 11 is received between the inner and outer walls 214, 215 in a sealedly sandwiched manner.

The enclosure arrangement 30 comprises a drinking hole plug 31 integrally extended from the lid cover 20. In particular, the drinking hole plug 31 is integrally and outwardly extended from the sealing edge 21 of the lid cover 20 in a detachably tearable manner. Therefore, the drinking hole plug 31 can be detached from the lid cover 20. After the drinking hole plug 31 is torn off from the lid cover 20, the drinking hole plug 31 is detachably engaged with and sealed at the drinking hole 23 for preventing beverage in the container 10 being leaked from the drinking hole 23.

As shown in FIGS. 2 and 3, the drinking hole plug 31 comprises a plug platform defining a tearable edge 311 integrally extended from the sealing edge 21 of the lid cover 20 and a plugging portion 312 upwardly protruded from the plug platform. The drinking hole plug 31 can be completely torn off from the sealing edge 21 of the lid cover 20 at the tearable edge 311, such that the plugging portion 312 of the drinking hole plug 31 can be detachably engaged with and sealed at the drinking hole 23. Accordingly, the size and shape of the plugging portion 312 of the drinking hole plug 31 matches with the size and shape of the drinking hole 23. It is worth mentioning that once the plugging portion 312 of the drinking hole plug 31 is fitted to the drinking hole 23, the drinking hole 23 will be completely sealed for prevent any leakage therethrough.

Accordingly, during the manufacturing process of the lid cover 20, the drinking hole plug 31 is formed at the same time to integrally form with the lid cover 20. Then, a tearing line may be formed at the tearable edge 311 of the drinking hole plug 31 to enable the user to easily tear off the drinking hole plug 31 from the lid cover 20. It is worth mentioning that two or more lids of the present invention can be stacked with each other to minimize the storage space of the lids.

The enclosure arrangement 30 further comprises a drinking plug pit 32 indently provided on the top cover 22 at a position adjacent to the drinking hole 23, such that after the drinking hole plug 31 is torn off from the lid cover 20, the drinking hole plug 31 is detachably engaged with the drinking plug pit 32 so as to temporally hold the drinking hole plug 31. In other words, the drinking hole plug 31 is selectively and detachably engaged with one of the drinking hole 23 and the drinking plug pit 32. When the drinking hole plug 31 is engaged with the drinking hole 23, the drinking hole 23 is sealed by the drinking plug 31. When the drinking hole plug 31 is engaged with the drinking plug pit 32, the drinking hole plug 31 is temporally held. As shown in FIG. 2, the drinking plug pit 32 is an indention formed at the top cover 22 of the lid cover 20, wherein the drinking plug pit 32 is not a through hole.

In particular, the plugging portion 312 of the drinking hole plug 31 is detachably engaged with the drinking plug pit 32 at a position that the plugging portion 312 of the drinking hole plug 31 is biased against a bottom side of the drinking plug pit 32. Therefore, when the user wants to seal the container 10, the user is able to plug the drinking hole plug 31 at the drinking hole 23 to completely seal the lid cover 20. When the user wants to drink the beverage, the user is able to detach the drinking hole plug 31 from the drinking hole 23 and then plug the drinking hole plug 31 at the drinking plug pit 32 to hold the drinking hole plug 31, so as to prevent the drinking hole plug 31 being lost.

In order to use the lid of the present invention, the user is able to fill the beverage into the container 10 and cover the lid cover 20 at the top opening 12 of the container 10, such that the user is able to drink the beverage through the drinking hole 23. For carrying or storing the container 10, the user is able to tear the drinking hole plug 31 from the lid cover 20 and plug the drinking hole plug 31 at the drinking hole 23. Therefore, the drinking hole 23 will be completely sealed by the drinking hole plug 31.

Figure 4:
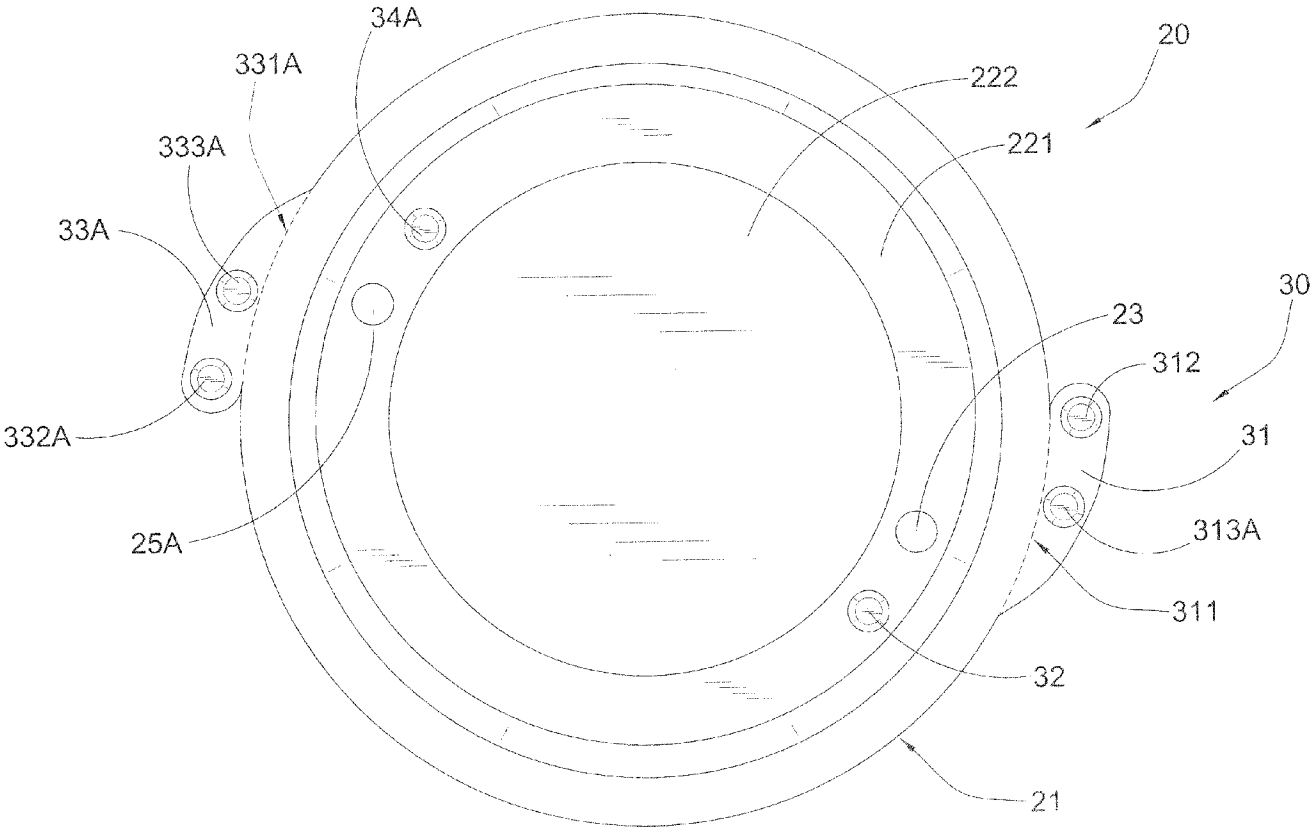
FIG. 4 is a top view of a lid according to a second preferred embodiment of the present invention.
Figure 5:
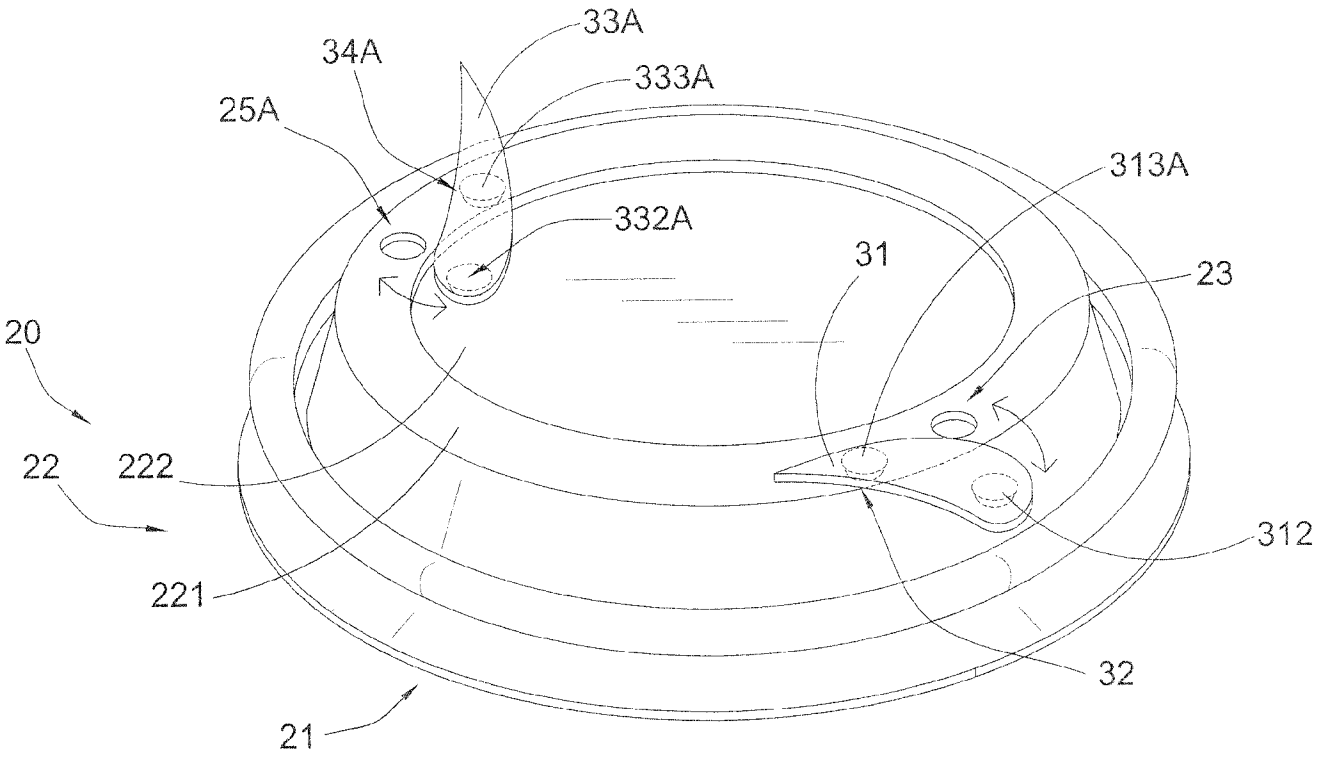
FIG. 5 is a top view of the lid according to the above second preferred embodiment of the present invention, illustrating the rotational movement of the enclosure arrangement.

As shown in FIGS. 4 and 5, a lid according to a second embodiment illustrates a modification of the first embodiment, wherein the size of the air vent 25A is slightly enlarged for enabling air easily to enter into the cavity of the container 10. In addition, the enclosure arrangement 30 further comprises a vent plug 33A integrally extended from the lid cover 20. In particular, the vent plug 33A is integrally and outwardly extended from the sealing edge 21 of the lid cover 20 in a detachably tearable manner. In other words, the drinking hole plug 31 and the vent plug 33A form two extension wings integrally and outwardly extended from two opposite sides of the sealing edge 21 of the lid cover 20. Therefore, the vent plug 33A can be detached from the lid cover 20. After the vent plug 33A is torn off from the lid cover 20, the vent plug 33A is detachably engaged with and sealed at the air vent 25A for preventing any external substance, such as dirt or dust, to enter into the container 10 through the air vent 25A.

According to the second embodiment, the structure of the vent plug 33A is similar to the structure of the drinking hole plug 31. The vent plug 33A comprises a vent plug platform defining a second tearable edge 331A integrally extended from the sealing edge 21 of the lid cover 20 and a vent plugging portion 332A upwardly protruded from the vent plug platform. The vent plug 33A can be completely torn off from the sealing edge 21 of the lid cover at the second tearable edge 331A, such that the vent plugging portion 332A of the vent plug 33A can be detachably engaged with and sealed at the air vent 25A. Accordingly, the size and shape of the vent plugging portion 332A of the vent plug 33A matches with the size and shape of the air vent 25A. It is worth mentioning that once the vent plugging portion 332A of the vent plug 33A is fitted to the air vent 25A, the air vent 25A will be completely sealed for prevent any leakage therethrough.

As shown in FIG. 4, the vent plug 33A and the drinking hole plug 31 are formed at the opposite side of the sealing edge 21 of the lid cover 20. Therefore, the user is able to selectively tear off the vent plug 33A and the drinking hole plug 31 from the sealing edge 21 of the lid cover 20. It is appreciated that the size and shape of the drinking hole 23 matches with the size and shape of the air vent 25A, such that the vent plug 33A and the drinking hole plug 31 are interchangeable to selectively couple with the drinking hole 23 and the air vent 25A.

According to the second embodiment, the enclosure arrangement 30 further comprises a vent plug pit 34A indently provided on the top cover at a position adjacent to the air vent 25A, such that after the vent plug 33A is torn off from the lid cover 20, the vent plug 33A is detachably engaged with the vent plug pit 34A so as to temporally hold the vent plug 33A. In other words, the vent plug 33A is selectively and detachably engaged with one of the air vent 25A and the vent plug pit 34A. When the vent plug 33A is engaged with the air vent 25A, the air vent 25A is sealed by the vent plug 33A. When the vent plug 33A is engaged with the vent plug pit 34A, the vent plug 33A is temporally held. The structure of the vent plug pit 34A is similar to the structure of the drinking plug pit 32, wherein the vent plug pit 34A is an indention formed at the top cover 22 of the lid cover 20 and is not a through hole.

In particular, the vent plugging portion 332A of the vent plug 33A is detachably engaged with the vent plug pit 34A at a position that the vent plugging portion 332A of the vent plug 33A is biased against a bottom side of the vent plug pit 34A. Therefore, when the user wants to seal the air vent 25A, the user is able to plug the vent plug 33A at the air vent 25A to completely seal the lid cover 20. When the user wants to drink the beverage, the user is able to detach the vent plug 33A from the air vent 25A and then plug the vent plug 33A at the vent plug pit 34A to hold the vent plug 33A, so as to prevent the vent plug 33A being lost. The opening of the air vent 25A allows air entering into the container 10 for enabling the user to drink easily.

Instead of detachably coupling the drinking hole plug 31 and the vent plug 33A at the drinking hole 23 and the air vent 25, the drinking hole plug 31 and the vent plug 33A can be rotatably coupled on the top cover 22, such that the plugging portion 312 and the vent plugging portion 332A of the drinking hole plug 31 and the vent plug 33A are rotatably moved to plug in the drinking hole 23 and the air vent 25A respectively.

As shown in FIG. 4, the drinking hole plug 31 further has a holding portion 313A upwardly extended from the plug platform and spaced apart from the plugging portion 312. The distance between the plugging portion 312 and the holding portion 313A of the drinking hole plug 31 matches with the distance between the drinking hole 23 and the drinking plug pit 32. After the drinking hole plug 31 is torn off from the lid cover 20, the holding portion 313A of the drinking hole plug 31 is coupled at the drinking plug pit 32 so as to enable the drinking hole plug 31 to be rotated on the top cover 22 to detachably engage and seal the plugging portion 312 at the drinking hole 23 as shown in FIG. 5. In other words, the user is able to selectively couple the plugging portion 312 of the drinking hole plug 31 with one of the drinking hole 23 and the drinking plug pit 32. As it is mentioned above, the drinking plug pit 32 can temporally hold the drinking hole plug 31 on the top cover 22. When the user selects to couple the holding portion 313A of the drinking hole plug 31 at the drinking plug pit 32, the drinking hole plug 31 can be rotatably moved on the top cover 22. It is worth mentioning that the user is able to plug or unplug the plugging portion 312 of the drinking hole plug 31 in or from the drinking hole 23 by one hand operation. Thus, the user is able to rotatably move the drinking hole plug 31 to align with or away from the drinking hole 23 by one hand operation. Therefore, the drinking plug pit 32 provides multiple functions to retain the drinking hole plug 31 on the top cover 22.

Similarly, the vent plug 33A further has a vent holding portion 333A upwardly extended from the vent plug platform and spaced apart from the vent plugging portion 332A. The distance between the vent plugging portion 332A and the vent holding portion 333A of the vent plug 33A matches with the distance between the air vent 25A and the vent plug pit 34A. After the vent plug 33A is torn off from the lid cover 20, the vent holding portion 333A of the vent plug 33A is coupled at the vent plug pit 34A so as to enable vent plug 33A to be rotated on the top cover 22 to detachably engage and seal the vent plugging portion 332A at the air vent 25A as shown in FIG. 5. Likewise, the user is able to selectively couple the vent plugging portion 332A of the vent plug 33A with one of the air vent 25 and the vent plug pit 34A. As it is mentioned above, the vent plug pit 34A can temporally hold the vent plug 33A on the top cover 22. When the user selects to couple the vent holding portion 333A of the vent plug 33A at the vent plug pit 34A, the vent plug 33A can be rotatably moved on the top cover 22. It is worth mentioning that the user is also able to plug or unplug the vent plugging portion 332A of the vent plug 33A in or from the air vent 25A by one hand operation. Thus, the user is able to rotatably move the vent plug 33A to align with or away from the air vent 25A by one hand operation. Therefore, the vent plug pit 34A also provides multiple functions to retain the vent plug 33A on the top cover 22.

It is worth mentioning that the holding portion 313A of the drinking hole plug 31 and the vent holding portion 333A of the vent plug 33A form the rotatable axles to enable the drinking hole plug 31 and the vent plug 33A to rotate on the top cover 22.

Figure 6:
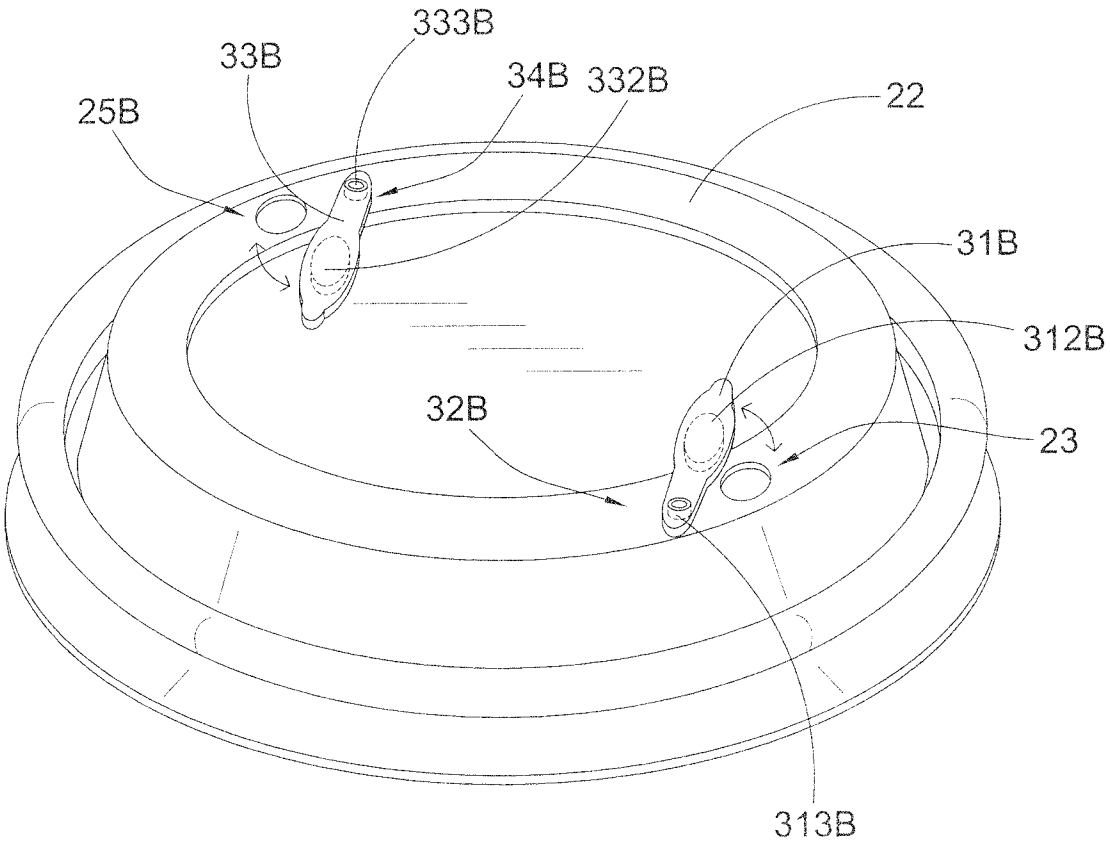
FIG. 6 illustrates a first alternative mode of the enclosure arrangement of the lid according to the above second preferred embodiment of the present invention.

FIG. 6 illustrates a first alternative mode of the second embodiment, the drinking hole plug 31B and the vent plug 33B are directly coupled on the top cover 22 at a rotatably movable manner. In other words, the drinking hole plug 31B and the vent plug 33B are not integrally extended from the sealing edge 21 of the lid cover 20 such that the user does not need to tear the drinking hole plug 31B and the vent plug 33B from the lid cover 20. In particular, the holding portion 313B of the drinking hole plug 31B is pre-coupled at the drinking plug pit 32B as a stud pin/hinge to enable the drinking hole plug 31B to be rotated on the top cover 22 so as to detachably engage and seal the plugging portion 312B at the drinking hole 23 as shown in FIG. 6. Likewise, the vent holding portion 333B of the vent plug 33B is pre-coupled at the vent plug pit 34B as another stud pin/hinge to enable vent plug 33B to be rotated on the top cover 22 so as to detachably engage and seal the vent plugging portion 332B at the air vent 25B as shown in FIG. 6.

Figure 7:
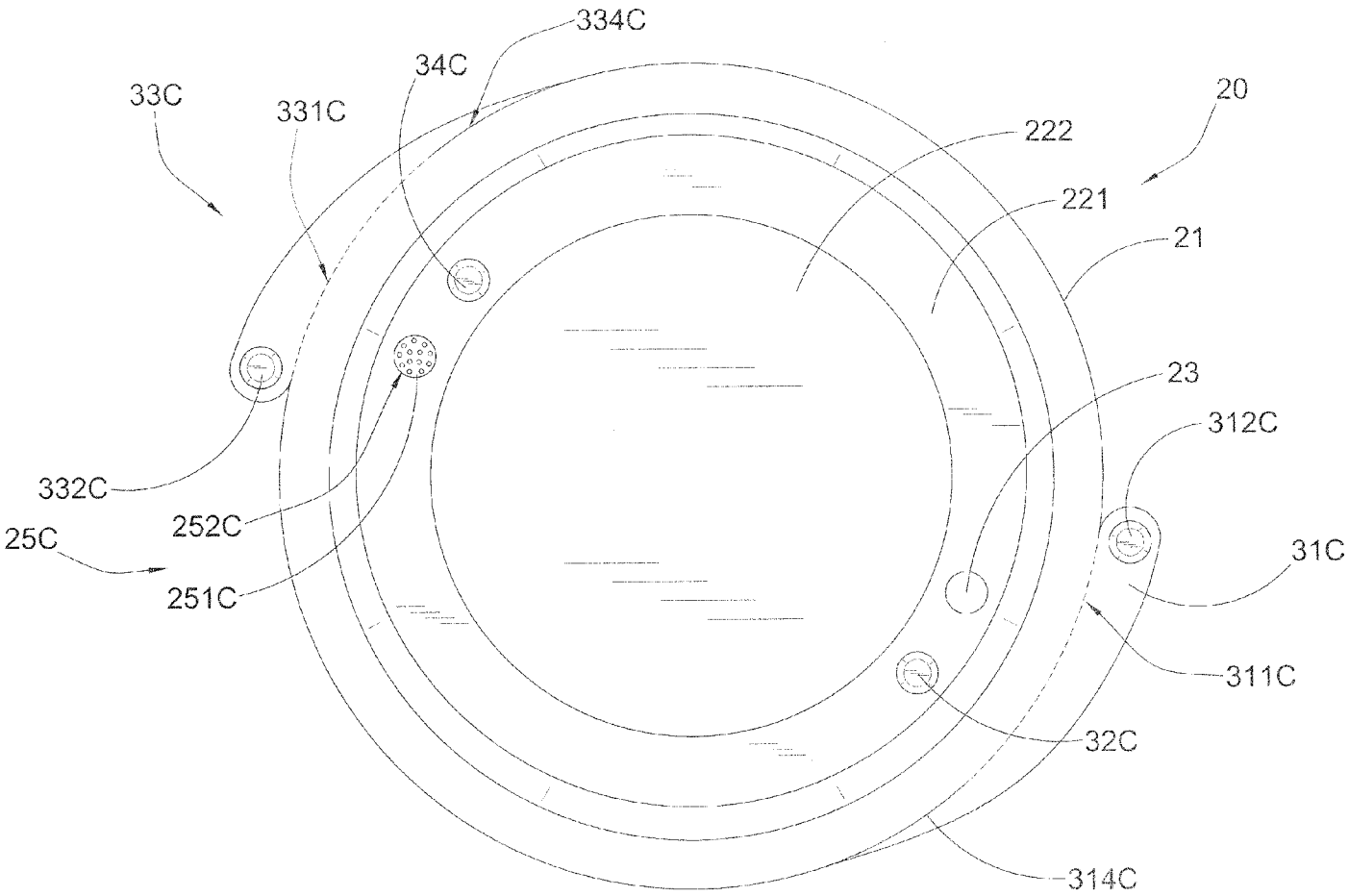
FIG. 7 illustrates a second alternative mode of the enclosure arrangement of the lid according to the above second preferred embodiment of the present invention.
Figure 8:
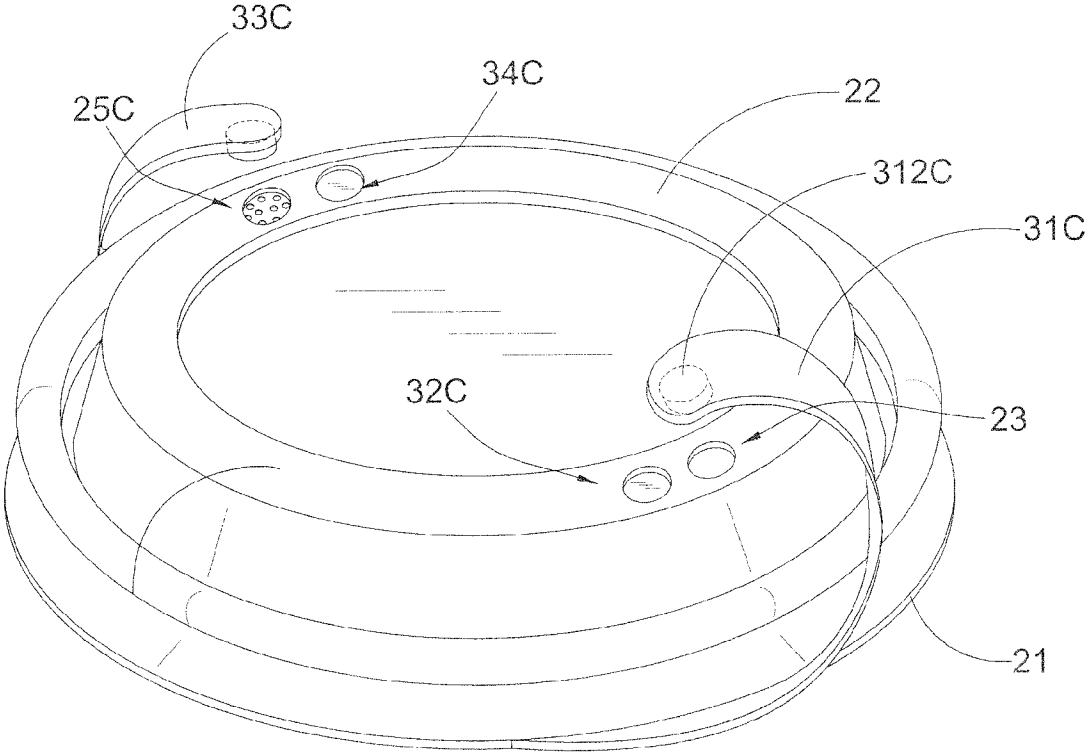
FIG. 8 illustrates the second alternative mode of the enclosure arrangement of the lid according to the above second preferred embodiment of the present invention, showing the drinking hole plug partially torn to plug in the drinking hole.

FIGS. 7 and 8 illustrates an alternative mode of the air vent 25C, wherein the air vent 25C is an indention formed at the top cover 22 of the lid cover 20 to define a bottom wall 251C. The air vent 25C further has a plurality of air pores 252C formed at the bottom wall 251C for enabling air passing therethrough. It is worth mentioning that the user is able to poke through the bottom wall 251C of the air vent 25C via the air pores 252C, for example by a straw, to form a poke hole such that the air pores 252C also form the perforation holes of the bottom wall 251C of the air vent 25C.

FIGS. 7 and 8 further illustrate a second alternative mode of the second embodiment, wherein the drinking hole plug 31C is integrally and outwardly extended from the sealing edge 21 of the lid cover 20 in a partially detachably tearable manner. Therefore, the drinking hole plug 31C can be partially detached from the lid cover 20. After the drinking hole plug 31C is partially torn off from the lid cover 20, the drinking hole plug 31C is detachably engaged with and sealed at the drinking hole 23 for preventing beverage in the container 10 being leaked from the drinking hole 23.

In particular, the plug platform can be extended at its length that a free end portion of the plug platform is integrally extended from the sealing edge 21 of the lid cover 20 to define a non-tearable edge 314C and a tearable edge 311C integrally extended from the sealing edge 21 of the lid cover 20. Therefore, the plug platform can be partially torn off from the sealing edge 21 of the lid cover 20 at the tearable edge 311C only while the plug platform is remained attached to sealing edge 21 of the lid cover at the non-tearable edge 314C. As a result, the plugging portion 312C of the drinking hole plug 31C can be detachably engaged with and sealed at the drinking hole 23. It is appreciated that the drinking hole plug 31C can be selectively engaged with one of the drinking hole 23 and the drinking plug pit 32C.

The structure of the vent plug 33C is similar to the structure of the drinking hole plug 31C, wherein the vent plug 33C is integrally and outwardly extended from the sealing edge 21 of the lid cover 20 in a partially detachably tearable manner. After the vent plug 33C is partially torn off from the lid cover 20, the vent plug 33C is detachably engaged with and sealed at the air vent 25C.

The vent plug platform can be extended at its length that a free end portion of the vent plug platform is integrally extended from the sealing edge 21 of the lid cover 20 to define a second non-tearable edge 334C and a second tearable edge 331C integrally extended from the sealing edge 21 of the lid cover 20. Therefore, the vent plug platform can be partially torn off from the sealing edge 21 of the lid cover 20 at the second tearable edge 331C only while the plug platform is remained attached to sealing edge 21 of the lid cover at the second non-tearable edge 334C. As a result, the vent plugging portion 332C of the vent plug 33C can be detachably engaged with and sealed at the air vent 25C. It is worth mentioning that the vent plug 33C can also be incorporated to detachably engage with and sealed at the air vent 25A. It is appreciated that the vent plug 33C can be selectively engaged with one of the air vent 25C and the vent plug pit 34C.

Accordingly, the plug platform of the drinking hole plug 31C and the vent plug platform of the vent plug 33C are made of flexible material, such that after the plug platform of the drinking hole plug 31C and the vent plug platform of the vent plug 33C, the plug platform of the drinking hole plug 31C and the vent plug platform of the vent plug 33C can be bent and flipped to engage with the drinking hole 23 and the air vent 25C. In other words, the plug platform of the drinking hole plug 31C and the vent plug platform of the vent plug 33C are long enough that the plugging portion 312C of the drinking hole plug 31C and the vent plugging portion 332C of the vent plug 33C can reach the drinking hole 23 and the air vent 25C.

It is worth mentioning that since the drinking hole plug 31C and the vent plug 33C are partially torn off from the sealing edge 21 of the lid cover 20, the end portions of the drinking hole plug 31C and the vent plug 33C are also held at the sealing edge 21 of the lid cover 20. Therefore, the holding portion 313A and the vent holding portion 333A can be omitted.

Figure 9:
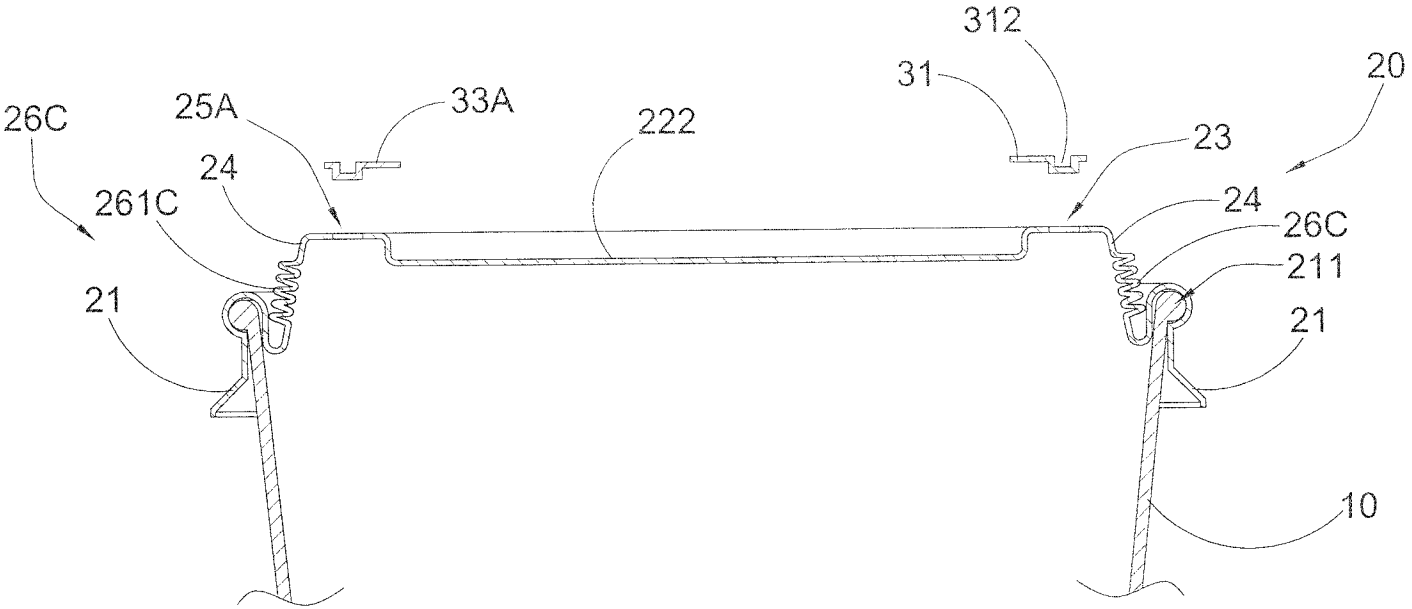
FIG. 9 is a sectional view of a lid according to a third preferred embodiment of the present invention.
Figure 10:
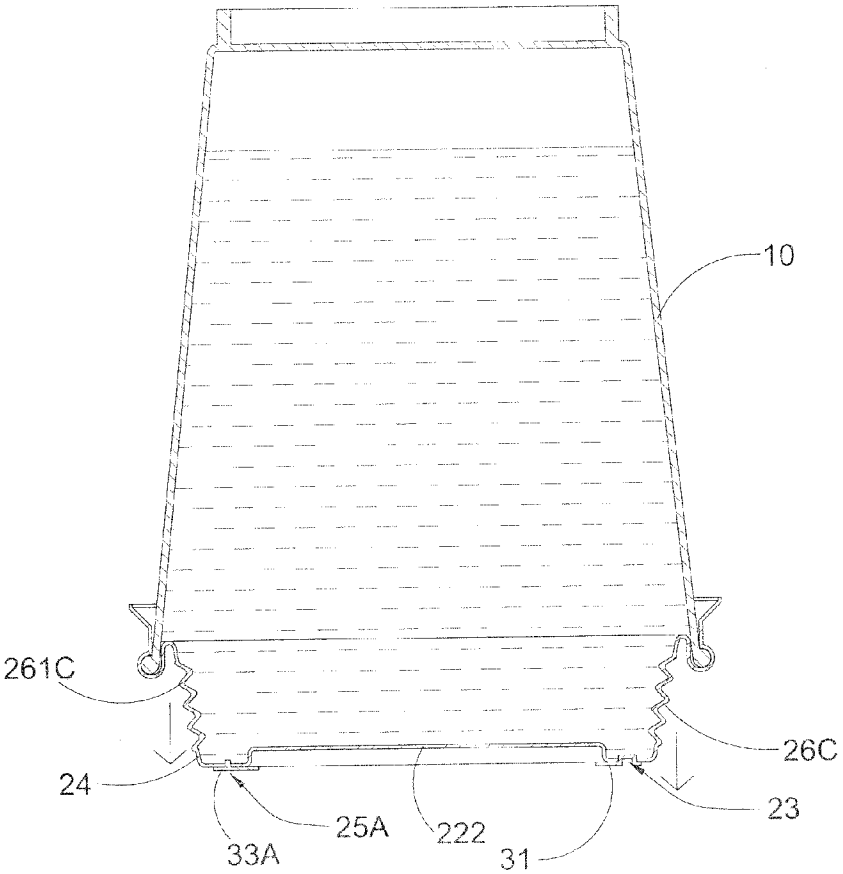
FIG. 10 is a sectional view of the lid according to the above third preferred embodiment of the present invention, illustrating the side expansion membrane.

As shown in FIGS. 9 and 10, a third embodiment of the lid illustrates a modification of the first and second embodiments of the present invention. According to the third embodiment, the lid cover 20 further comprises an expansion membrane 26C for creating a negative pressure within the container 10 when the container 10 is placed in a non upright position, i.e. the container 10 is tilted or is placed up-side-down.

As shown in FIG. 9, the expansion membrane 26C is formed at the surrounding wall 24 of the lid cover 20 as a side expansion membrane. In particular, the expansion membrane 26C comprises a corrugated wall 261C integrally formed at the surrounding wall 24. In other words, at least a portion of the surrounding wall 24 is formed in a corrugated shape.

According to the preferred embodiment, the expansion membrane 26C can be deformed to expand the volume of the container 10 with the lid cover 20. For example, when the container 10 is placed up-side-down or tilted, the beverage will be filled at the lid cover 20. The weight of the beverage will push the lid cover 20 downwardly to stretch out the corrugated wall 261C at the surrounding wall 24. In other words, the top cover 22 will be forced to move away from the top opening 12 of the container 10 or the overall height of the lid cover 20 will be substantially increased via the stretched surrounding wall 24, as shown in FIG. 10.

When the volume of the container 10 with the lid cover 20 is expanded, in condition that the container 10 is located up-side-down, the negative pressure is created in the container 10. Since the ambient pressure is larger than the interior pressure of the container 10, the larger ambient pressure will prevent the beverage from being leaked out through the drinking hole 23 or the air vent 25A. In other words, the expansion membrane 26C will cause the lid cover 20 being popped open from the container 10 due to hot coffee (or hot beverage) sudden mix with relatively cold air therein and cause a quenching effect and sudden interior air pressure surge, otherwise.

Figure 11:
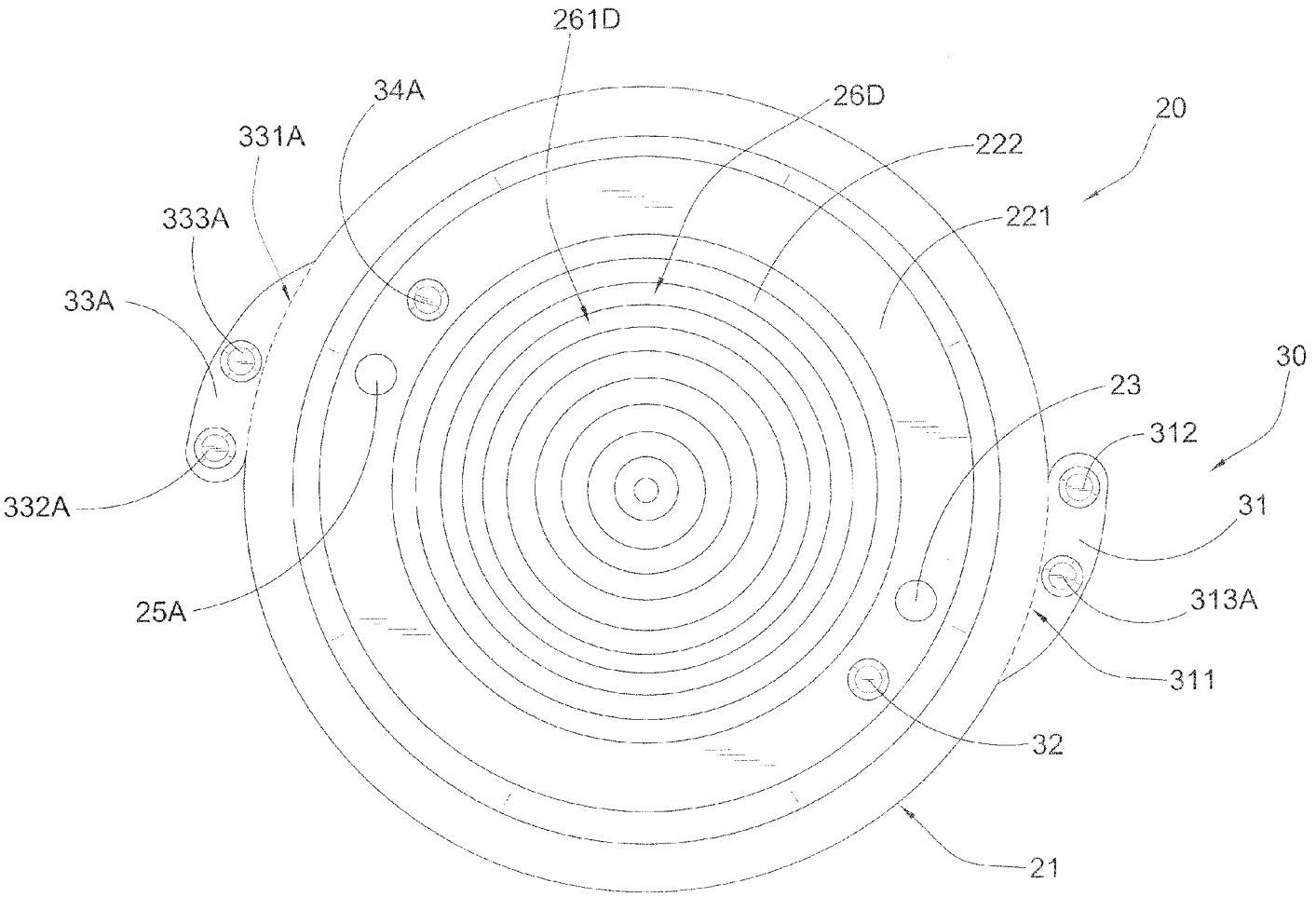
FIG. 11 is a top view of a lid according to a fourth preferred embodiment of the present invention.
Figure 12:
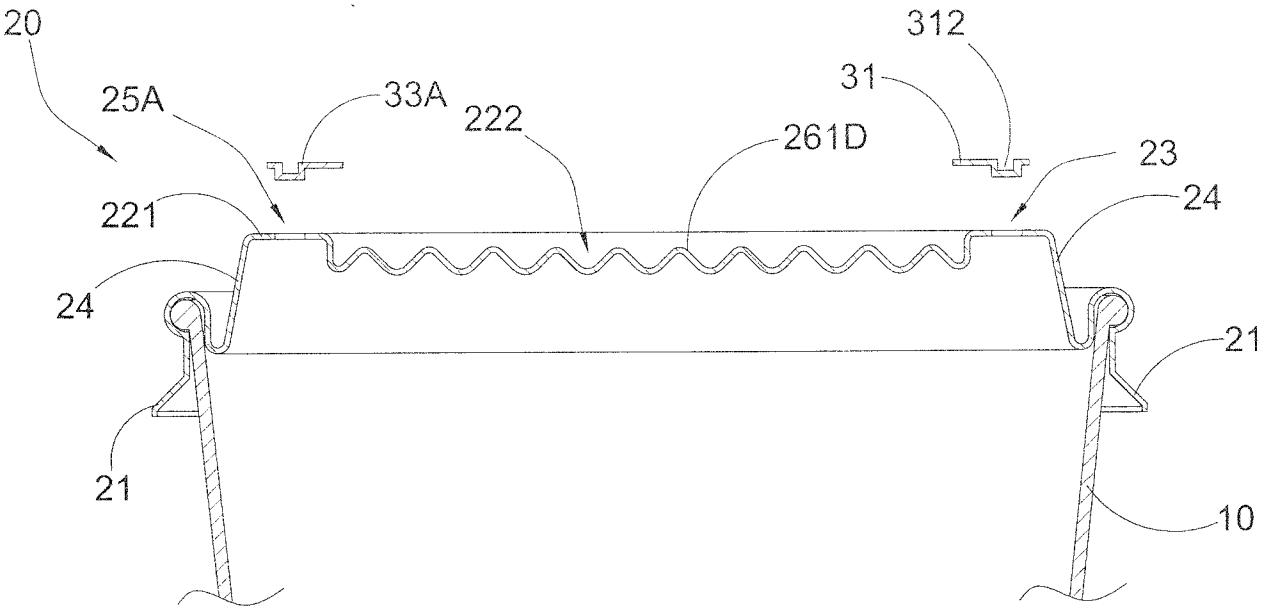
FIG. 12 is a sectional view of the lid according to the above fourth preferred embodiment of the present invention.

FIGS. 11 and 12 illustrate an alternative mode of the expansion membrane 26D of the third embodiment, wherein the expansion membrane 26D is formed at a top side of the lid cover 20. In particular, the expansion membrane 26D is formed at the center lowered platform 222 of the lid cover 20 as a top expansion membrane. In particular, the expansion membrane 26D comprises a corrugated wall 261D integrally formed at the center lowered platform 222 of the lid cover 20. In other words, at least a portion of the center lowered platform 222 of the lid cover 20 is formed in a corrugated shape.

Figure 13:
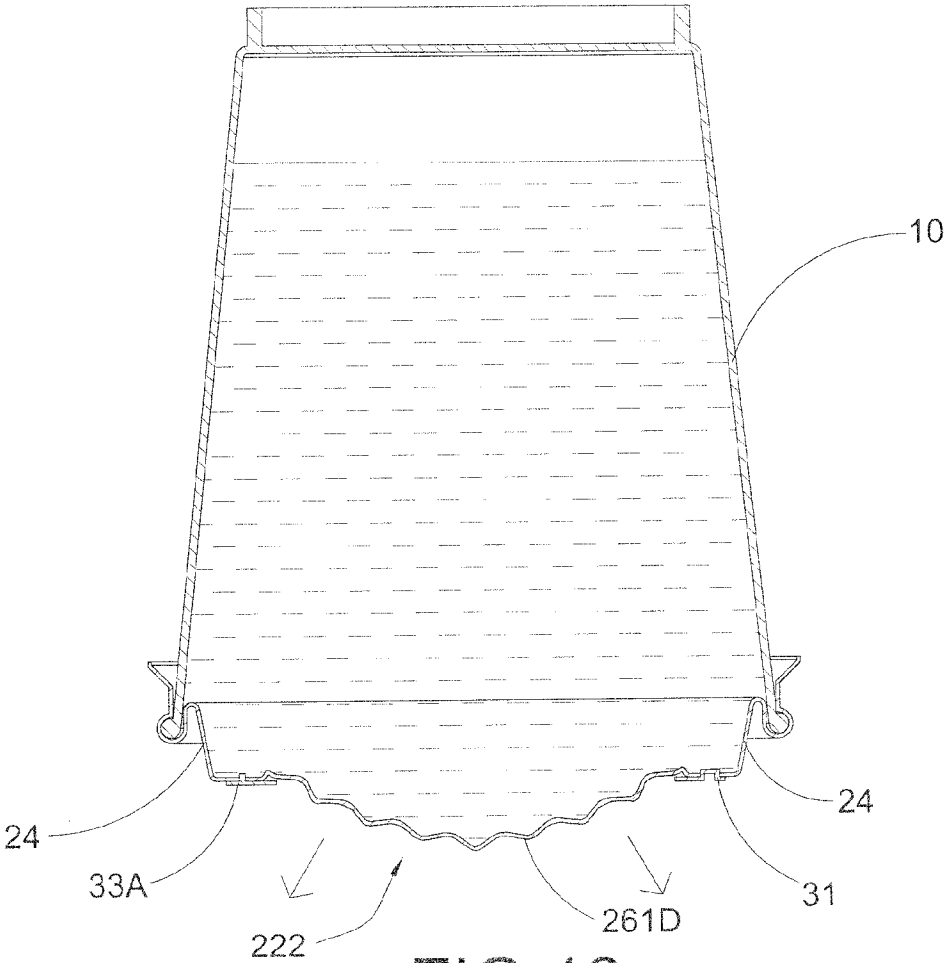
FIG. 13 is a sectional view of the lid according to the above fourth preferred embodiment of the present invention, illustrating the top expansion membrane.

Likewise, the expansion membrane 26D can be deformed to expand the air volume of the container 10 with the lid cover 20. For example, when the container 10 is placed up-side-down, the beverage will be filled at the lid cover 20. The weight of the beverage will push the lid cover 20 downwardly to stretch out the corrugated wall 261D at the center lowered platform 222 of the lid cover 20. In other words, the center lowered platform 222 of the lid cover 20 will be forced to move away from the top opening 12 of the container 10 or the overall height of the lid cover 20 will be substantially increased via the stretched center lowered platform 222 of the lid cover 20, as shown in FIG. 13. It is worth mentioning that when the center lowered platform 222 of the lid cover 20 is stretched, the center lowered platform 222 of the lid cover 20 forms a conical shape. It is appreciated that the expansion membrane 26D can be a flexible membrane formed at the center lowered platform 222 of the lid cover 20 to create the negative pressure. In addition, the flexible membrane can be transparent that the user is able to see through the flexible membrane.

Figure 14:
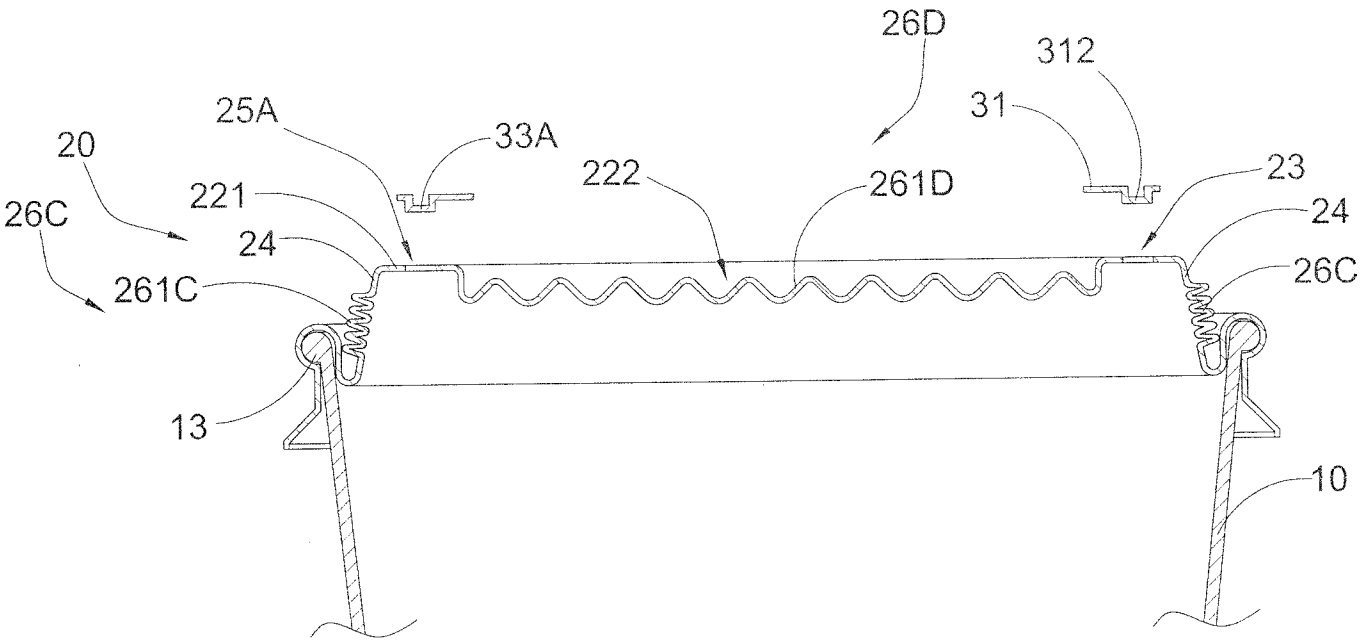
FIG. 14 is a sectional view of the lid according to a fifth preferred embodiment of the present invention, illustrating the top and side expansion membranes.

FIG. 14 illustrates a combination of the top and side expansion membranes. Accordingly, the expansion membranes 26C, 26D are formed at surrounding wall 24 and the center lowered platform 222 of the lid cover 20 respectively. Therefore, when the container 10 is placed up-side-down, the weight of the beverage will stretch out the corrugated wall 261C at the surrounding wall 24 and push down the corrugated wall 261D at the center lowered platform 222 of the lid cover 20 at the same time. Accordingly, the negative pressure will be substantially increased.

Figure 15:
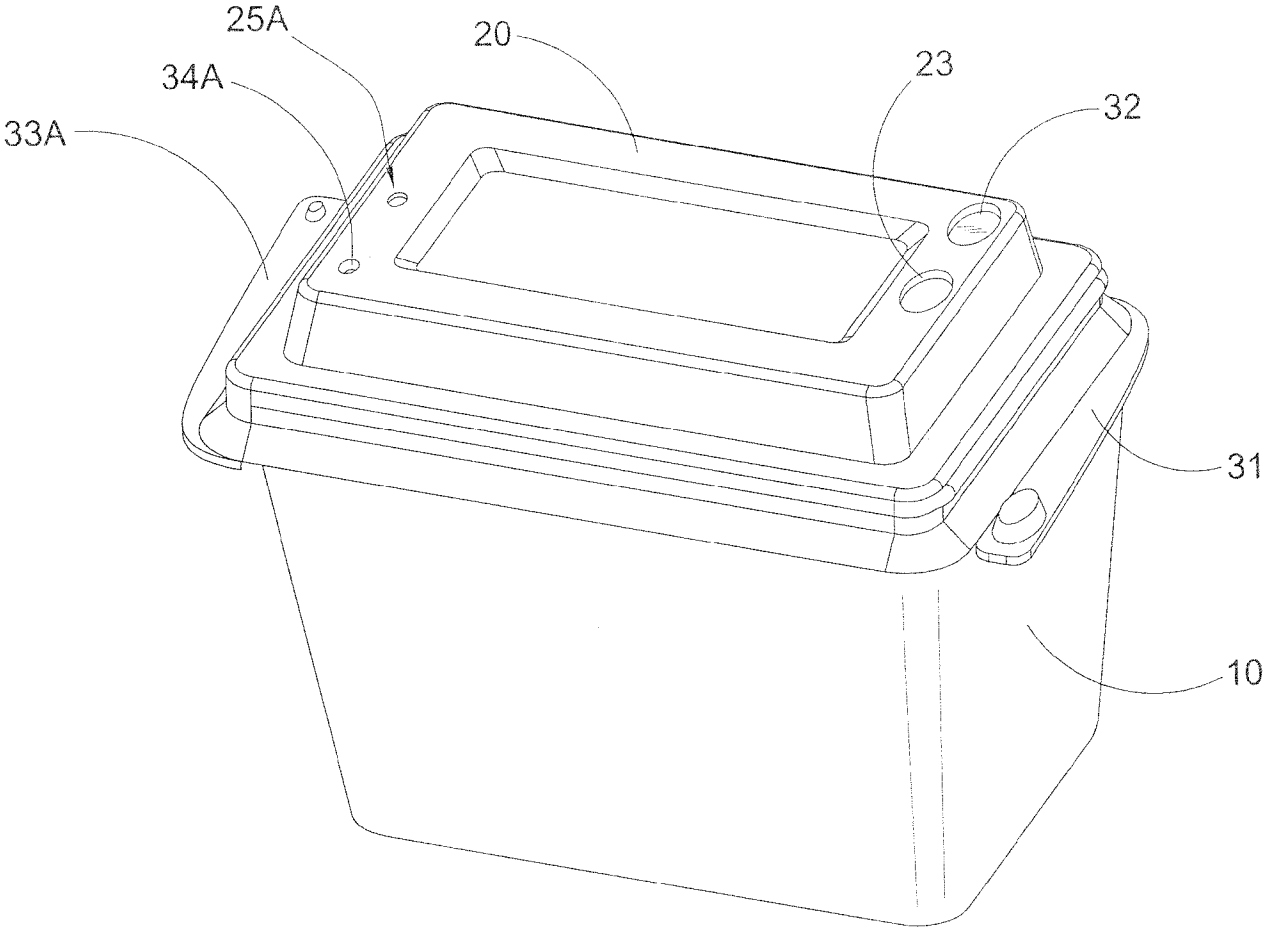
FIG. 15 illustrates an alternative mode of the lid for the disposable beverage cup according to the above first to fifth preferred embodiments of the present invention, illustrating the lid in a different shape.

FIG. 15 illustrates the lid cover 20 formed in different shape. The lid cover 20 can be formed in a rectangular shape to match with the corresponding shape of the top opening of the container 10. Likewise, it is appreciated that the lid cover 20 can be formed in polygonal shape or oval shape to cover the container 10.

It is worth mentioning that the second to fifth embodiments and their alternative modes are the modifications of the first embodiment that the structural features of the first to fifth embodiments are interchangeable. For example, the expansion membranes 26C, 26D can be formed at the lid cover 20 of the first and second embodiments. Likewise, the expansion membranes 26C, 26D can be formed at the lid cover 20 can be formed with the drinking hole plug 31C and the vent plug 33C with the partially detaching feature. The air vent 25C with the air pore feature can be formed at any one of the above mentioned embodiments and their alternatives.

According to the present invention, the lid is manufactured by the following steps.

(1) Form the lid cover 20 with the peripheral sealing edge 21 and the top cover 22. Accordingly, the drinking hole 23 and/or the vent hole 25 can be found at the same time.

(2) Integrally form the drinking hole plug 31 and the vent plug 33A along the sealing edge 21 of the lid cover 20 at two opposed or distant sides.

(3) Form the tearable lines at the tearable edges 311, 331A of the drinking hole plug 31 and the vent plug 33A respectively. Therefore, the drinking hole plug 31 and the vent plug 33A can be easily detached from the lid cover 20.

In the step (1), the drinking plug pit 32 and/or the vent plug pit 34A can be formed at the top cover 22. In addition, the expansion membrane 26C, 26D can also be formed at the surrounding wall 24 and/or the center lowered platform 222 of the lid cover 20 in the step (1). All the structures of the lid cover 20 with the drinking hole plug 31 and the vent plug 33A can be integrally formed by thermoforming or pressing or even injection.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lid for a container, comprising:

a lid cover adapted for covering at a top opening of said container, wherein said lid cover has a drinking hole and an air vent spacedly formed at a peripheral portion of said lid cover to maximize a distance between said drinking hole and said air vent; and an enclosure arrangement which comprises a drinking hole plug movably extended from said lid cover detachably engaged with and sealed at said drinking hole, and a vent plug movably extended from said lid cover detachably engaged with and sealed at said air vent, wherein said drinking hole plug and said vent plug are two individual plugs that said drinking hole plug and said vent plug selectively and individually cover at said drinking hole and said air vent respectively, wherein said enclosure arrangement further comprises a vent plug pit indently provided on said lid cover at a position adjacent to said air vent, wherein said vent plug is selectively engaged with one of said air vent and said vent plug pit.

2. The lid, as recited in claim 1, wherein said drinking plug has a plugging portion, wherein said drinking hole plug is rotatably coupled at said lid cover to detachably engage and seal said plugging portion of said drinking hole plug at said drinking hole, wherein said vent plug has a vent plugging portion, wherein said vent plug is rotatably coupled at said lid cover to detachably engage and seal said vent plugging portion of said vent hole plug at said air vent.

3. The lid, as recited in claim 1, wherein said air vent has a bottom wall and a plurality of air pores formed thereon for enabling air passing therethrough only, wherein said bottom wall of said air vent is adapted to be poked through to form a poke hole for allowing a straw passing therethrough.

4. The lid, as recited in claim 1, wherein said lid cover comprises an expansion membrane for creating a negative pressure within said container when said container is placed in a non upright position.

5. The lid, as recited in claim 1, wherein said enclosure arrangement further comprises a drinking plug pit indently provided on said lid cover at a position adjacent to said drinking hole, wherein said drinking hole plug is selectively engaged with one of said drinking hole and said drinking plug pit.

6. The lid, as recited in claim 5, wherein said drinking hole plug is integrally and outwardly extended from said lid cover and is completely torn off from said lid cover to enable said drinking hole plug to be detachably engaged with and sealed at said drinking hole, wherein said vent plug is integrally and outwardly extended from said lid cover and is completely torn off from said lid cover to enable said vent plug to be detachably engaged with and sealed at said air vent.

7. The lid, as recited in claim 6, wherein said drinking hole plug has a plugging portion and a holding portion, wherein after said drinking hole plug is completely torn off from said lid cover, said holding portion of said drinking hole plug is coupled at said drinking plug pit to enable said drinking hole plug to be rotated on said lid cover to detachably engage and seal said plugging portion at said drinking hole, wherein said vent plug has a vent plugging portion and a vent holding portion, wherein after said vent plug is completely torn off from said lid cover, said vent holding portion of said vent plug is coupled at said vent plug pit to enable said vent plug to be rotated on said top cover to detachably engage with and seal the vent plugging portion at said air vent.

8. The lid, as recited in claim 5, wherein said drinking hole plug further has a holding portion coupled at said drinking plug pit and a plugging portion detachably coupled at said drinking hole, wherein said vent plug further has a vent holding portion coupled at said vent plug pit and the vent plugging portion detachably coupled at said air vent.

9. The lid, as recited in claim 8, wherein said holding portion of said drinking hole plug is coupled at said drinking plug pit as a stud hinge to enable said drinking hole plug to be rotated on said lid cover so as to detachably engage and seal said plugging portion at said drinking hole, said vent holding portion of said vent plug is coupled at said vent plug pit as a second stud hinge to enable said vent plug to be rotated on said lid cover so as to detachably engage and seal said vent plugging portion at said air vent.

10. A lid for a container, comprising:

a lid cover adapted for covering at a top opening of said container, wherein said lid cover has a drinking hole and an air vent spacedly formed at a peripheral portion of said lid cover to maximize a distance between said drinking hole and said air vent; and an enclosure arrangement which comprises a drinking hole plug movably extended from said lid cover detachably engaged with and sealed at said drinking hole, and a vent plug movably extended from said lid cover detachably engaged with and sealed at said air vent, wherein said drinking hole plug and said vent plug are two individual plugs that said drinking hole plug and said vent plug selectively and individually cover at said drinking hole and said air vent respectively, wherein said enclosure arrangement further comprises a drinking plug pit indently provided on said lid cover at a position adjacent to said drinking hole, wherein said drinking hole plug is selectively engaged with one of said drinking hole and said drinking plug pit.

11. The lid, as recited in claim 10, wherein said drinking hole plug is integrally and outwardly extended from said lid cover and is completely torn off from said lid cover to enable said drinking hole plug to be detachably engaged with and sealed at said drinking hole.

12. The lid, as recited in claim 11, wherein said drinking hole plug has a plugging portion and a holding portion, wherein after said drinking hole plug is completely torn off from said lid cover, said holding portion of said drinking hole plug is coupled at said drinking plug pit to enable said drinking hole plug to be rotated on said lid cover to detachably engage and seal said plugging portion at said drinking hole.

13. The lid, as recited in claim 10, wherein said drinking hole plug further has a holding portion coupled at said drinking plug pit and a plugging portion detachably coupled at said drinking hole.

14. The lid, as recited in claim 13, wherein said holding portion of said drinking hole plug is coupled at said drinking plug pit as a stud hinge to enable said drinking hole plug to be rotated on said lid cover so as to detachably engage and seal said plugging portion at said drinking hole.

15. A lid for a container, comprising:

a lid cover adapted for covering at a top opening of said container, wherein said lid cover has a drinking hole and an air vent spacedly formed at a peripheral portion of said lid cover to maximize a distance between said drinking hole and said air vent; and an enclosure arrangement which comprises a drinking hole plug movably extended from said lid cover detachably engaged with and sealed at said drinking hole, and a vent plug movably extended from said lid cover detachably engaged with and sealed at said air vent, wherein said drinking hole plug and said vent plug are two individual plugs that said drinking hole plug and said vent plug selectively and individually cover at said drinking hole and said air vent respectively, wherein said drinking hole plug is integrally and outwardly extended from said lid cover and is completely torn off from said lid cover to enable said drinking hole plug to be detachably engaged with and sealed at said drinking hole.

16. A lid for a container, comprising:

a lid cover adapted for covering at a top opening of said container, wherein said lid cover has a drinking hole and an air vent spacedly formed at a peripheral portion of said lid cover to maximize a distance between said drinking hole and said air vent; and an enclosure arrangement which comprises a drinking hole plug movably extended from said lid cover detachably engaged with and sealed at said drinking hole, and a vent plug movably extended from said lid cover detachably engaged with and sealed at said air vent, wherein said drinking hole plug and said vent plug are two individual plugs that said drinking hole plug and said vent plug selectively and individually cover at said drinking hole and said air vent respectively, wherein said drinking hole plug integrally and outwardly extended from said lid cover and is partially torn off from said lid cover to enable said drinking hole plug to be detachably engaged with and sealed at said drinking hole, wherein said drinking hole plug is flipped from said lid cover to detachably engage with and seal said drinking hole after said drinking hole plug is partially torn off from said lid cover.

* * * * *